US006541745B2

(12) United States Patent
Kim et al.

(10) Patent No.: US 6,541,745 B2
(45) Date of Patent: Apr. 1, 2003

(54) HEATER SYSTEM FOR MICROWAVE OVEN

(75) Inventors: Seog Tae Kim, Changwon (KR); Seong Yun Ryu, Changwon (KR); Geun Hyung Lee, Busan (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/986,735

(22) Filed: Nov. 9, 2001

(65) Prior Publication Data

US 2002/0056712 A1 May 16, 2002

(30) Foreign Application Priority Data

Nov. 10, 2000 (KR) ..... 2000/0066850

(51) Int. Cl.[7] ..... H05B 6/80

(52) U.S. Cl. ..... 219/681; 219/685; 219/757; 219/400; 126/21 A

(58) Field of Search ..... 219/681, 685, 219/757, 400; 126/21 A, 273 A, 275 E

(56) References Cited

U.S. PATENT DOCUMENTS 4,481,396 A * 11/1984 Matsubayashi et al. ..... 219/681
6,005,235 A * 12/1999 Shin ..... 219/757
6,093,918 A * 7/2000 Sohn ..... 219/685

FOREIGN PATENT DOCUMENTS

JP 5-52352 * 3/1993 ..... 219/757

* cited by examiner

*Primary Examiner*—Philip H. Leung
(74) *Attorney, Agent, or Firm*—Birch, Stewart, Kolasch & Birch, LLP

(57) ABSTRACT

In a heater system for a microwave oven including an air tunnel having an suction portion and a discharge portion, formed at an upper surface of a cooking chamber, a fan assembly installed inside the air tunnel and having a circulation fan forming air flow by sucking air inside the cooking chamber through the suction portion and discharge the sucked air through the air tunnel and the discharge portion, a first heater chamber having a first heater installed inside the air tunnel and heating air discharged into the discharge portion from the air tunnel, and a second heater chamber having a second heater installed inside the air tunnel and emitting radiation heat into the cooking chamber, wherein the suction portion and the discharge portion are formed near opposite side walls of the cooking chamber.

7 Claims, 2 Drawing Sheets

HEATER SYSTEM FOR MICROWAVE OVEN

BACKGROUND OF THE INVENTION

1. Field of the Invention

The present invention relates to a microwave oven, and in particular to a heater system for a microwave oven which is capable of transferring heat from a heater to cooking object more efficiently.

2. Description of the Related Art

A microwave oven heats cooking object by using microwave energy. Recently, in order to add various heating functions to a microwave oven, a heater is installed as another heating source besides microwave energy and heat generated by the heater is used for heating cooking object.

FIG. 1 is a sectional view illustrating construction of a heater system for a microwave oven in accordance with a prior art.

As depicted in FIG. 1, in the heater system for the microwave oven in accordance with the prior art, a cooking chamber 2 is formed inside a cavity in order to cook cooking object F placed on a tray 2'.

An additional heater chamber 5 is formed at the upper portion of an upper plate 3 forming a ceiling of the cooking chamber 2, and heaters 7, 7' for heating the cooking object F on the tray 2' are installed inside the heater chamber 5.

And, a circulation fan 9 is installed at the center portion of the heater chamber 5, and is rotated by a circulation motor 10 on the upper portion of the heater chamber 5.

And, a suction portion 3S and a discharge portion 3E for air circulation generated by the circulation fan 9 are respectively formed on the upper plate 3 corresponded to the bottom surface of the heater chamber 5.

Herein, the suction potion 3S is formed at a position corresponded to the circulation fan 9, and the discharge portion 3E is formed at a position corresponded to the heaters 7, 7'. The suction portion 3S and the discharge portion 3E are formed as a plurality of air passage holes.

In the heater system for the microwave oven in accordance with the prior art, in order to perform heating with the heaters 7, 7', power is applied to the heaters 7, 7', heat is generated, and at the same time the circulation fan 9 is operated.

By the rotation of the circulation fan 9, air inside the cooking chamber 2 is sucked into the heater chamber 5 through the suction portion 3S, the sucked air is heated while passing through the heaters 7, 7' in the heater chamber 5 and is discharged into the cooking chamber 2 through the discharge portion 3E.

The heated air discharged into the cooking chamber 3 heats the cooking object F and is again sucked into the heater chamber 5 through the suction portion 3S.

However, there are problems, which will be described in the following, in the heater system for the microwave oven in accordance with the prior art.

First, air flow inside the cooking chamber 2 is formed at the suction portion 3S at a center of the upper plate and the discharge portion 3E at the circumference on the basis of the ceiling of the cooking chamber 2 formed by the upper plate 3, and such air flow does not circulate the whole cooking chamber 2 uniformly.

In more detail, air flow is well-performed mostly at the upper center portion of the cooking chamber 2 adjacent to the circulation fan 9, air flow is not well-performed at the lower portion of the cooking chamber 2, especially at the corner portion of the cooking chamber 2, and accordingly air discharged through the discharge portion 3E is directly sucked into the suction portion 3S as shown with arrows in FIG. 1.

Accordingly, heat transfer inside the cooking chamber 2 is not uniform and the uniform heating of the cooking object F can not be performed.

In addition, air flowing into the heater chamber 5 by the circulation fan 9 is heated by passing through the heaters 7, 7', passes the discharge portion 3E formed at the upper plate 3 and is discharged into the cooking chamber 2, herein lots of heat loss is occurred by transferring large amount of heat to the upper plate 3. In more detail, heat to be transferred to the cooking object F is transferred to the upper plate 3 first, accordingly heat loss occurs.

In the meantime, the air convection by the circulation fan 9 is performed by connecting the cooking chamber 2 and the heater chamber 5, for the convection of air, the discharge portion 3E is formed at the upper plate 3 corresponded to the heaters 7, 7'. However, impurities such as pieces of cooking object or fat, etc. in the cooking object 2 can be conveyed to the heaters 7, 7' through the discharge portion 3E. Particularly, because the impurities in the cooking chamber 2 can spit to the upper portion of the cooking chamber 2, the heaters 7, 7' can be easily contaminated.

SUMMARY OF THE INVENTION

Accordingly, in order to solve the above-mentioned problems, it is an object of the present invention to provide a heater system for a microwave oven which is capable of heating cooking object uniformly by improving convection of heat generated by heater.

It is another object of the present invention to provide a heater system for a microwave oven which is capable of transferring heat generated by heater to cooking object more efficiently.

It is yet another object of the present invention to provide a heater system for a microwave oven which is capable of improving operation reliability of a heater mostly using a radiation heat.

In order to achieve the above-mentioned objects, a heater system for a microwave oven in accordance with the present invention includes a cooking chamber having an upper surface and side walls; an air tunnel having a suction portion and a discharge portion, said air tunnel formed at the upper surface of the cooking chamber; a fan assembly installed inside the air tunnel, said fan assembly having a circulation fan forming air flow by sucking air inside the cooking chamber through the suction portion and discharging the sucked air through the discharge portion by passing the air tunnel; a first heater chamber having a first heater installed inside the air tunnel and heating air discharged through the discharge portion; and a second heater chamber having a second heater installed inside the air tunnel and emitting radiation heat into the cooking chamber, wherein the suction portion and the discharge portion are formed near opposite side walls of the cooking chamber.

In addition, the first heater chamber is installed directly at an upper portion of the discharge portion, is divided from the air tunnel by a first reflection plate having a plurality of connection holes, and is opened so as to be directly connected to the cooking chamber.

The second heater chamber is positioned between the suction portion and the discharge portion and is defined formed by a second reflecting plate. And it is preferable to install the second heater chamber between the suction portion and the discharge portion.

The second heater chamber is divided from the cooking chamber by a filter capable of permeating a radiation heat into the cooking chamber.

In the heater system for the microwave oven in accordance with the present invention, the air flow inside the cooking chamber by the circulation fan can be formed more uniformly, accordingly the heat can be transferred to cooking object more efficiently.

DETAILED DESCRIPTION OF THE PREFERRED EMBODIMENT

A heater system for a microwave oven in accordance with the present invention will be described in detail with reference to accompanying drawings.

Figure 1:
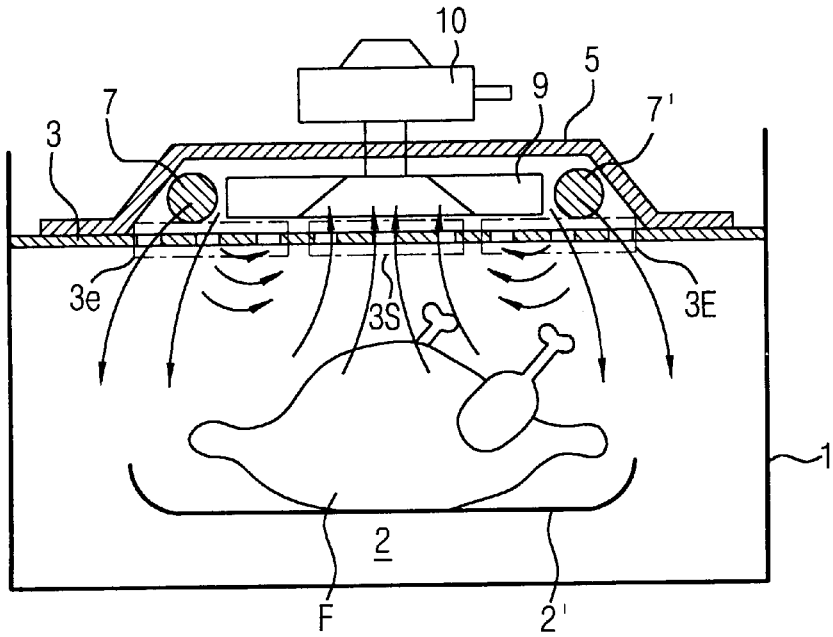
FIG. 1 BACKGROUND ART
FIG. 1 is a sectional view illustrating a heater system for a microwave oven in accordance with a prior art.
Figure 2:
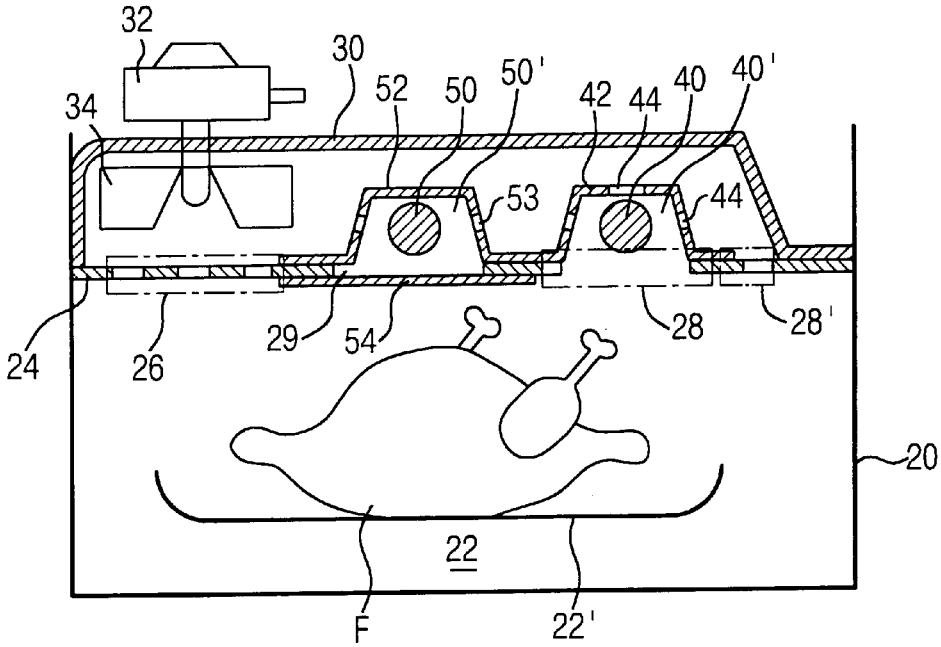
FIG. 2 is a sectional view illustrating a construction of a heater system for a microwave oven in accordance with the present invention.

FIG. 2 is a sectional view illustrating a construction of a heater system for a microwave oven in accordance with the present invention.

As depicted in FIG. 2, a cooking chamber 22 is formed inside a cavity 20 of a microwave oven. In the cooking chamber 22, a cooking object F on a tray 22' is cooked by microwave energy supplied by a magnetron (not shown) installed at an electric room(not shown), or by heat generated by a heater system.

An upper plate 24 is formed at the upper surface of the cooking chamber 22 and, at the same time forms a ceiling of the cooking chamber 22, a suction portion 26 forming air flow from the inside of the cooking chamber 22 and a discharge portion 28 forming air flow from the outside of the cooking chamber 22 are respectively formed at the upper plate 24.

Herein, the suction portion 26 is formed in the upper plate 24 at one side of the cooking chamber 22, and the discharge portion 28 is formed in the upper plate 24 at another side of the cooking chamber 22 opposite to the suction portion 26.

The discharge portion 28 is formed to have a certain area for directly connecting a space in which a first heater 40, namely a first heater chamber 40' with the cooking chamber 22.

And, in order to make air flow smoother, an auxiliary discharge portion 28' is formed around the discharge portion 28 in the upper plate 24.

Herein, it is preferable to place the suction portion 26 around one outer end of the tray 22' and the discharge portion 28 around another end of the tray 22' opposite to the one outer end.

In the meantime, an air tunnel 30 is formed on the upper plate 24. A circulation fan 34 is installed inside the air tunnel 30, it is preferable to install the circulation fan 34 near to the suction portion 26, as depicted in FIG. 2, it is most preferable to install the circulation fan 34 directly at upper position of the suction portion 26.

The air inside the cooking chamber 22 is sucked into the air tunnel 30 through the suction portion 26 by the circulation fan 34, the sucked air is discharged into the cooking chamber 22 by passing through the air tunnel 30, a first heater chamber 40' and the discharge portion 28 of the air tunnel 30. A circulation motor 32 installed at the upper portion of the air tunnel 30 operates the circulation fan 34.

The first heater 40 transferring heat to cooking object F by convection is installed at the upper portion of the discharge portion 28 formed at the opposite position of the suction portion 26. Particularly, the first heater chamber 40' is formed inside the air tunnel 30, defined by a first reflecting plate 42 having a plurality of connection holes 44 at the upper position of the discharge portion 28, and the heat transfer inside the cooking chamber 22 can be performed efficiently by installing the first heater 40 inside the heater chamber 40'.

The air passed through the air tunnel 30 flows through the plurality of connection holes 44 formed at the first reflecting plate 42 into the cooking chamber 22. Herein, a ceramic heater can be used as the first heater 40.

And, a second heater 50 emitting radiation heat into cooking object F is installed between the suction portion 26 and the discharge portion 28. As depicted in FIG. 2, the second heater 50 is installed inside a second heater chamber 50'. In more detail, the second heater chamber 50' is defined by the upper plate 24 and the second reflecting plate 52.

And a plurality of holes 53 are formed in the second reflecting plate 52, though which the air sucked into the air tunnel from the inside of the cooking chamber 22 flows. With the airflow through the plurality of holes 53 formed in the second reflecting plate can cool the second reflecting plate 52 and the second heater.

An opened portion 29 is formed at the upper plate 24 and defines the second heater chamber 50' together with the second reflecting plate 52, accordingly the second heater 50 emits radiation heat to the cooking chamber 22 through the opened portion 29.

In the meantime, such as a glass filter 54 is installed at the opened portion 29 in order to prevent penetration of impurities from the cooking chamber 22, accordingly contamination of the second heater 50 can be prevented and radiation heat can be easily transferred. It is preferable to use such as a halogen lamp as the second heater 50.

The operation of the heater system for the microwave oven in accordance with the present invention will be described.

Figure 3:
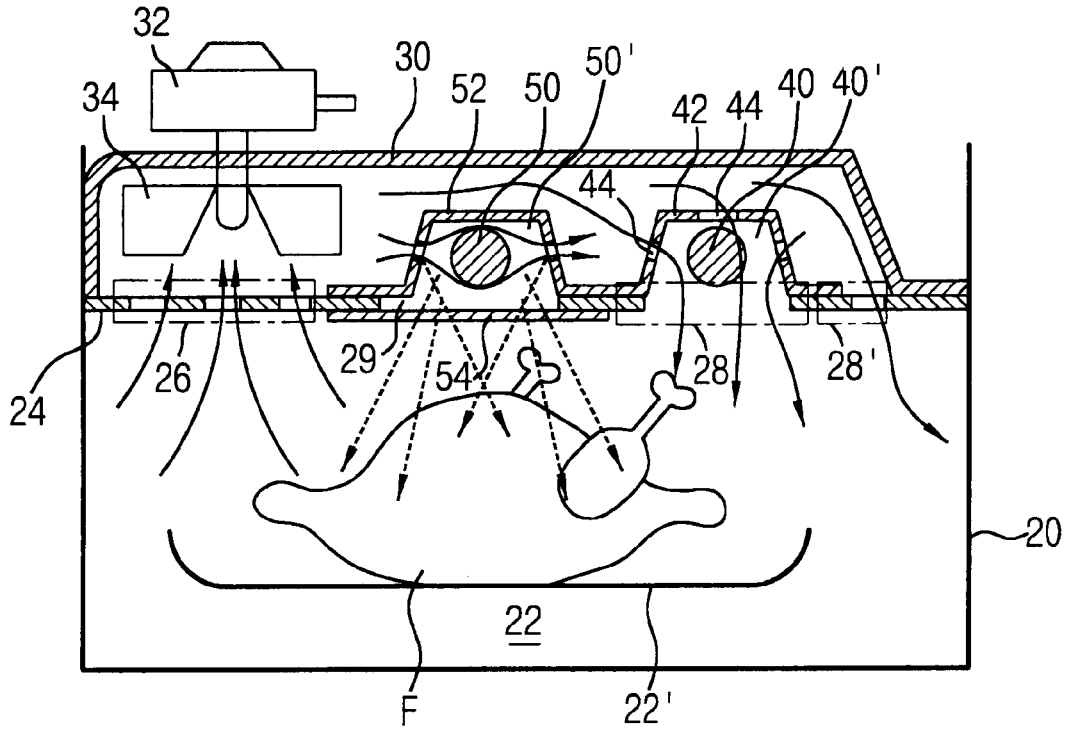
FIG. 3 is a sectional view illustrating operation state by a heater of a heater system for a microwave oven in accordance with the present invention.

FIG. 3 is a sectional view illustrating operation state of a heater of a heater system for a microwave oven in accordance with the present invention.

When the heater system using the heaters 40, 50 starts to operate, the first heater 40 and the second heater 50 generate heat, and the circulation fan 34 is operated by the circulation motor 32.

When the circulation fan 34 operates, as depicted in FIG. 3, the air inside the cooking chamber 22 is sucked into the air tunnel 30 through the suction portion 26. The air sucked into the air tunnel 30 flows toward the first reflecting plate 42 covering the first heater 40 by passing through the upper portion of the second reflecting plate 52 covering the second heater 50.

The air flows toward the first heater 40 through the connection hole 44 formed at the first reflecting plate 42 covering the first heater 40, the air heated in the first heater 40 flows into the side of the cooking chamber 22 through the discharge portion 28.

The air flowing into the cooking chamber 22 heats cooking object F by flowing into the cooking chamber 22 by the air flow formed by the circulation fan 34 and flows again into the air tunnel 30 through the suction portion 26. Herein, the auxiliary discharge portion 28' performs a function for forming air flow together with the whole connection holes 44 formed at the first reflecting plate 42.

Herein, because the discharge portion 28 is formed as not a plurality of holes but one hole having a certain area, the air flow passing the first heater 40 can flow into the cooking chamber 22 more smoothly, and the heat transferred from the first heater 40 can be wholly transferred to cooking object F with small heat loss transferred to the upper plate 24.

In the meantime, the heat generated in the second heater 50 is transferred to cooking object F as a radiation heat (shown as arrows in FIG. 3) transferring through the glass filter 54 installed at the opened portion 29 into the cooking chamber 22 and heats cooking object F.

Herein, only the radiation heat radiating through the glass filter 54 can be transferred to cooking object F and the radiation heat is not affected by the internal circumstances. Accordingly, the second heater 50 is not contaminated by impurities from the cooking chamber 22.

And, because the second reflecting plate 52 covering the second heater 50 is installed inside the air tunnel 30, the second reflecting plate 52 can be cooled by the air flow formed by the circulation fan 34, and it is possible to prevent excessive temperature rising of the second reflecting plate 52 although the output of the second heater 50 is relatively high and, at the same time the air cooling the second reflecting plate 52 is heated by the second reflecting plate 52.

Additionally, all elements of the heater system can be installed in one heater chamber.

As described above, in the heater system for the microwave oven in accordance with the present invention, by forming the air flow uniformly inside the cooking chamber, it is possible to heat cooking object uniformly without installing an additional heater at the lower portion of the cooking chamber, and particularly, heat can be transferred uniformly to the cooking object with smaller heat loss in the heat transferring process by the convection and radiation of the heater system installed at the upper portion of the cooking chamber.

And, by constructing the heater supplying the radiation heat so as to be divided from the internal circumstances of the cooking chamber, it is possible to prevent the heater from being contaminated by impurities from the cooking chamber, and because the reflecting plate of the heater can be efficiently cooled by the air flow formed by the circulation fan, the cooking can be performed quickly by adjusting the output of the heater relatively high.

What is claimed is:

1. A heater system for a microwave oven, comprising:

a cooking chamber having an upper surface and side walls;

an air tunnel having a suction portion and a discharge portion, said air tunnel formed at the upper surface of the cooking chamber;

a fan assembly installed inside the air tunnel, said fan assembly having a circulation fan forming air flow by sucking air inside the cooking chamber through the suction portion and discharging the sucked air through the discharge portion by passing the air tunnel;

a first heater chamber having a first heater installed inside the air tunnel and heating air discharged through the discharge portion; and a second heater chamber having a second heater installed inside the air tunnel and emitting radiation heat into the cooking chamber, wherein the suction portion and the discharge portion are formed near opposite side walls of the cooking chamber.

2. The system of claim 1, wherein the first heater chamber is installed directly at an upper portion of the discharge portion, is divided from the air tunnel by a first reflection plate having a plurality of connection holes, and is opened so as to be directly connected to the cooking chamber.

3. The system of claim 1, wherein the second heater chamber is positioned between the suction portion and the discharge portion and is defined formed by a second reflecting plate.

4. The system of claim 3, wherein the second heater chamber is divided from the cooking chamber by a filter capable of permeating a radiation heat into the cooking chamber.

5. The system of claim 4, wherein the filter is a glass filter.

6. The system of claim 1, wherein the second heater chamber is divided from the cooking chamber by a filter capable of permeating a radiation heat into the cooking chamber.

7. The system of claim 1, wherein the circulation fan of the fan assembly is positioned directly at an upper portion of the suction portion in the air tunnel.

* * * * *